US012085365B2

(12) United States Patent
Xiong et al.

(10) Patent No.: US 12,085,365 B2
(45) Date of Patent: Sep. 10, 2024

(54) SHOCK ABSORPTION DEVICE FOR PHOTOELECTRIC INSTRUMENT FOR GUN

(71) Applicant: WUHAN GOLDEN MINNA PHOTOELECTRIC SCI&TECH CO., LTD, Wuhan (CN)

(72) Inventors: Haibei Xiong, Wuhan (CN); Min Xiong, Wuhan (CN); Xiaoming Peng, Wuhan (CN); Fan Hu, Wuhan (CN); Xing Zhao, Wuhan (CN); Shaoyong Li, Wuhan (CN)

(73) Assignee: WUHAN GOLDEN MINNA PHOTOELECTRIC SCI & TECH CO., LTD, Wuhan (CN)

( * ) Notice: Subject to any disclaimer, the term of this patent is extended or adjusted under 35 U.S.C. 154(b) by 295 days.

(21) Appl. No.: 17/861,241

(22) Filed: Jul. 10, 2022

(65) Prior Publication Data

US 2023/0375309 A1 Nov. 23, 2023

(30) Foreign Application Priority Data

May 19, 2022 (CN) ..... 202221209478.1

(51) Int. Cl.
*F41G 11/00* (2006.01)

(52) U.S. Cl.
CPC ..... *F41G 11/002* (2013.01); *F41G 11/003* (2013.01)

(58) Field of Classification Search
CPC ..... F41G 11/002; F41G 11/003
See application file for complete search history.

(56) References Cited

U.S. PATENT DOCUMENTS

| | | | | |
|---|---|---|---|---|
| 4,026,054 | A * | 5/1977 | Snyder | F41G 11/002 362/110 |
| 4,027,414 | A * | 6/1977 | Felix | F41G 11/002 42/127 |
| 6,449,893 | B2 * | 9/2002 | Spinner | F41G 11/001 42/126 |
| 6,678,988 | B1 * | 1/2004 | Poff, Jr. | F41G 11/003 42/147 |
| 7,954,270 | B2 * | 6/2011 | Bentley | F41G 11/003 42/72 |
| 8,205,375 | B1 * | 6/2012 | Swan | F41G 1/38 42/124 |
| 8,347,544 | B1 * | 1/2013 | Swan | F41G 1/38 42/124 |
| 10,048,040 | B1 * | 8/2018 | Ratliff | F41G 11/001 |
| 10,352,658 | B1 * | 7/2019 | Aslin | F41G 11/003 |

(Continued)

*Primary Examiner* — Michelle Clement

(57) ABSTRACT

Disclosed is a shock absorption device for photoelectric instrument for gun, comprising a bracket, a buffer mechanism, and a connection mechanism; a card block is formed on the bracket, and a perforation is formed on the card block; the buffer mechanism includes a buffer seat, a slide bar, and a cushioning elastic; the connection mechanism is mounted on the bracket and used to be detachably connected to Picatinny rail on a sniper rifle. When shooting, the sniper rifle recoils, the sniper rifle drives the Picatinny rail to recoil, the Picatinny rail drives the bracket to recoil through the connection mechanism, the bracket acts on the cushioning elastic, and the cushioning elastic contracts, which can buffer the photoelectric instrument for the gun installed on the buffer seat, reduce the recoil of the photoelectric instrument for gun, and prolong its service life.

10 Claims, 6 Drawing Sheets

(56) References Cited

U.S. PATENT DOCUMENTS

| | | | | |
|---|---|---|---|---|
| 10,365,069 | B1 * | 7/2019 | Tayon | F41G 11/003 |
| 10,724,569 | B2 * | 7/2020 | Windfeldt | F16B 33/02 |
| 10,942,009 | B2 * | 3/2021 | Galli | F41G 1/35 |
| 11,029,131 | B2 * | 6/2021 | Cahill | F41G 11/003 |
| 11,306,999 | B2 * | 4/2022 | Ma | F41G 1/387 |
| 12,000,673 | B2 * | 6/2024 | Zimmer | F41G 11/001 |
| 2022/0282956 | A1 * | 9/2022 | Yan | F41G 11/003 |
| 2022/0357127 | A1 * | 11/2022 | Sun | G02B 27/20 |
| 2024/0093967 | A1 * | 3/2024 | Karagias | F41G 11/001 |

* cited by examiner

SHOCK ABSORPTION DEVICE FOR PHOTOELECTRIC INSTRUMENT FOR GUN

FIELD OF THE DISCLOSURE

The disclosure relates to the technical field of sniper gun accessory, in particular to shock absorption device for photoelectric instrument for gun.

BACKGROUND

Sniper rifles are usually equipped with photoelectric instrument (such as scope) to achieve functions such as aiming at targets.

The photoelectric instruments for guns are usually detachably installed on the Picatinny rails on the sniper rifle (for the specific structure of the Picatinny rails, please refer to the Chinese patent with the application number CN201020163100.3). The Picatinny rail itself does not have the function of shock absorption. When shooting, the photoelectric instrument will be subjected to a strong recoil, which shortens the service life of the photoelectric instrument.

SUMMARY

The purpose of this disclosure is to overcome the above technical deficiencies and provide a shock absorption device for photoelectric instrument for gun, which is used to solve the technical problem that the photoelectric instrument for gun is subjected to a strong recoil force, which shortens the service life of the photoelectric instrument for gun.

This disclosure provides a shock absorption device for photoelectric instrument for gun, comprising a bracket, a buffer mechanism, and a connection mechanism;

A card block is formed on the bracket, and a perforation is formed on the card block;

The buffer mechanism includes a buffer seat, a slide bar, and a cushioning elastic, the buffer seat is used for detachable connection with photoelectric instrument for gun, the slide bar is fixed on the buffer seat, the slide bar is slidably inserted in the perforation, the cushioning elastic is sleeved on the slide bar, one end of the cushioning elastic is connected to the buffer seat, the other end of the cushioning elastic is connected to the card block;

The connection mechanism is mounted on the bracket and used to be detachably connected to Picatinny rail on a sniper rifle.

The beneficial effects of this disclosure include: when in use, first installing the connection mechanism on the Picatinny rail on sniper rifle, and then install the photoelectric instrument for gun on the buffer seat. When shooting, the sniper rifle recoils, the sniper rifle drives the Picatinny rail to recoil, the Picatinny rail drives the bracket to recoil through the connection mechanism, the bracket acts on the cushioning elastic, and the cushioning elastic contracts, which can buffer the photoelectric instrument for the gun installed on the buffer seat, reduce the recoil of the photoelectric instrument for gun, and prolong its service life.

BRIEF DESCRIPTION OF THE DRAWINGS

Accompanying drawings are for providing further understanding of embodiments of the disclosure. The drawings form a part of the disclosure and are for illustrating the principle of the embodiments of the disclosure along with the literal description. Apparently, the drawings in the description below are merely some embodiments of the disclosure, a person skilled in the art can obtain other drawings according to these drawings without creative efforts. In the figures.

DETAILED DESCRIPTION OF PREFERRED EMBODIMENTS

Figure 1:
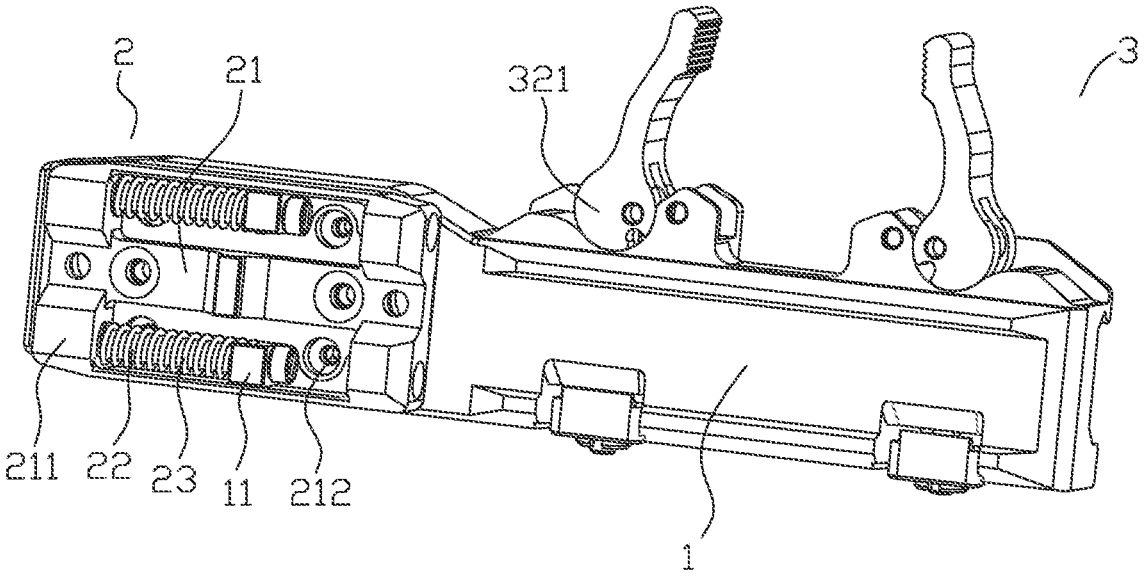
FIG. 1 is a schematic three-dimensional structure diagram of an embodiment of the shock absorption device for photoelectric instrument for gun provided by this disclosure when the knob is in an unlocked position.
Figure 2:
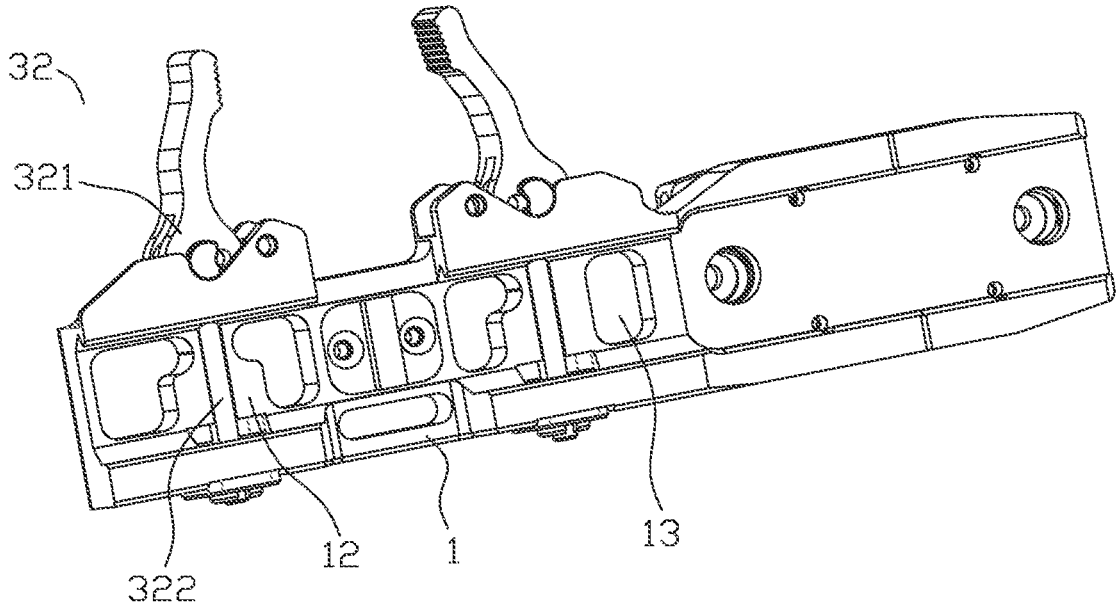
FIG. 2 is the three-dimensional structure schematic diagram of the damping device in FIG. 1 in another viewing angle.
Figure 3:
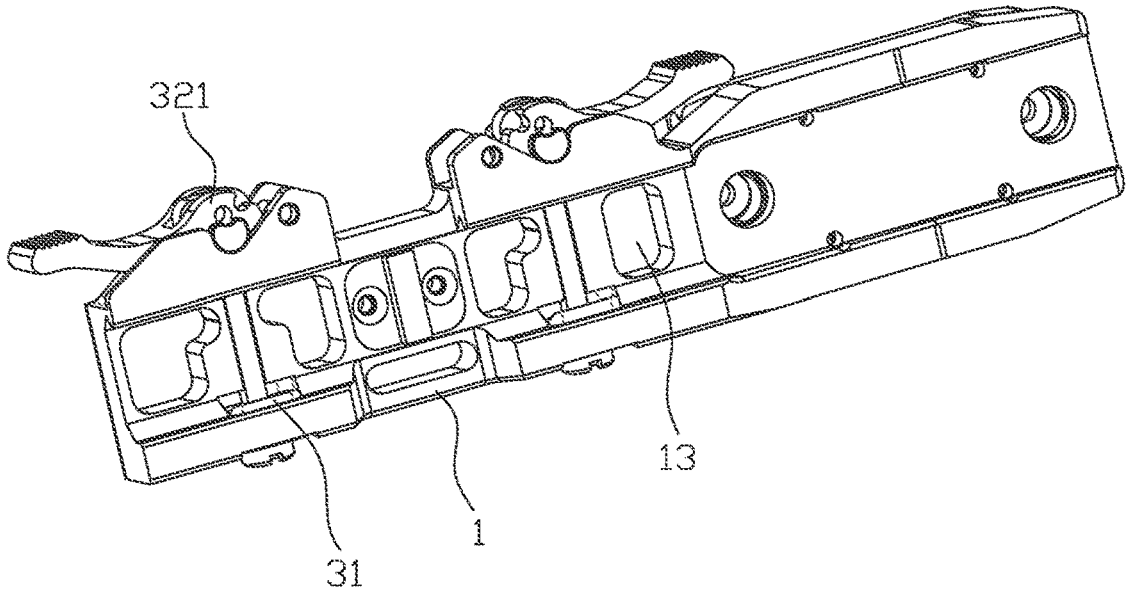
FIG. 3 is the three-dimensional structure schematic diagram of the damping device in FIG. 2 when the knob is in a locking position.
Figure 4:
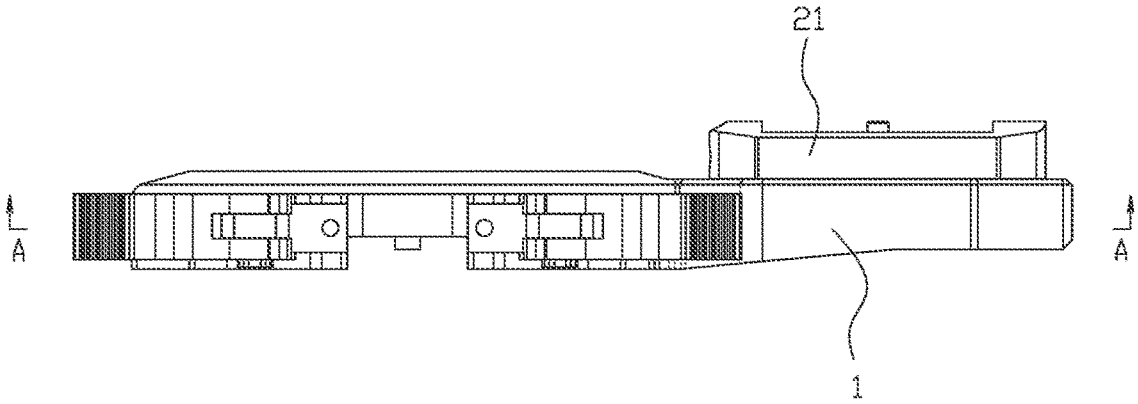
FIG. 4 is the top view of FIG. 3.
Figure 5:
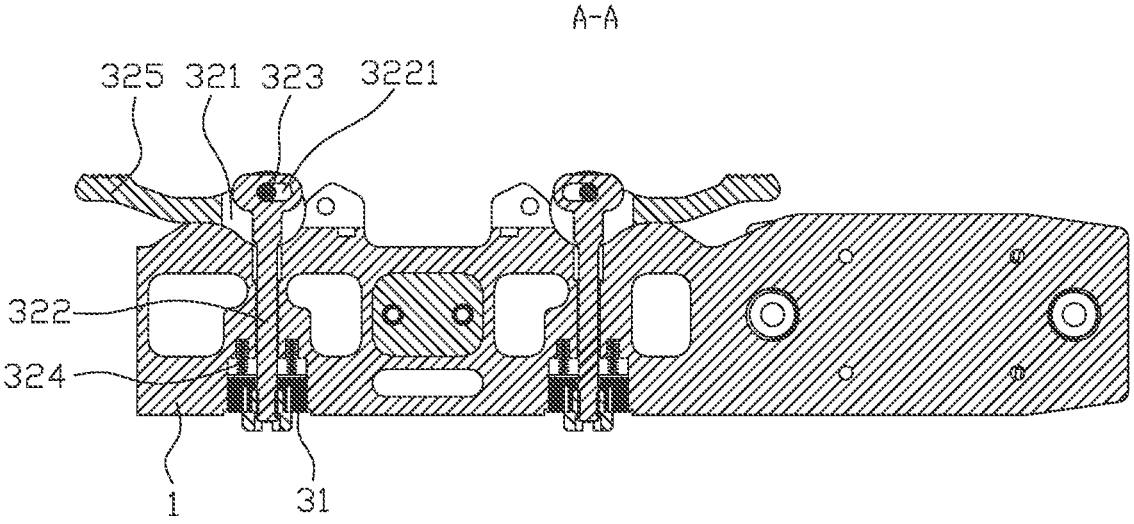
FIG. 5 is the sectional view of section A-A in FIG. 4.
Figure 6:
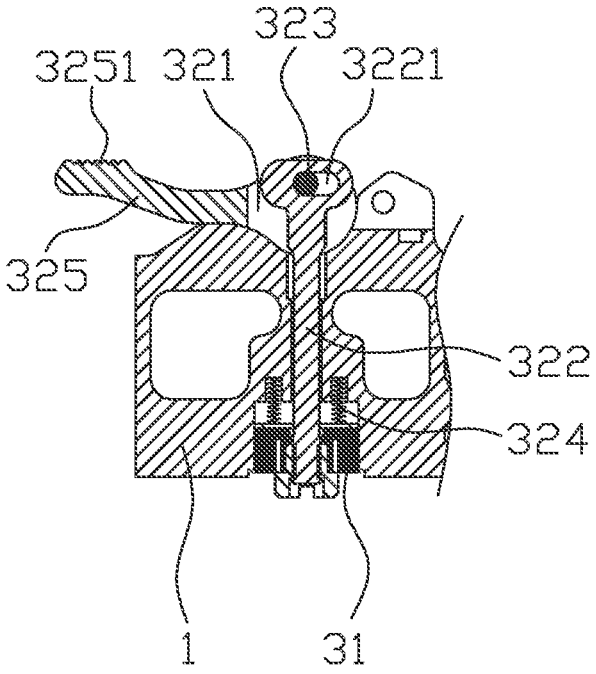
FIG. 6 is the structural representation of the connection mechanism in FIG. 5.

Please refer to FIG. 1 to FIG. 7, this disclosure provides a shock absorption device for photoelectric instrument for gun, comprising a bracket 1, a buffer mechanism 2, and a connection mechanism 3.

A card block 11 is formed on the bracket 1, and a perforation is formed on the card block 11.

The buffer mechanism 2 includes a buffer seat 21, a slide bar 22, and a cushioning elastic 23, the buffer seat 21 is used for detachable connection with photoelectric instrument (such as a scope) for gun, the slide bar 22 is fixed on the buffer seat 21, the slide bar 22 is slidably inserted in the perforation, the cushioning elastic 23 is sleeved on the slide bar 22, one end of the cushioning elastic 23 is connected to the buffer seat 21, the other end of the cushioning elastic 23 is connected to the card block 11.

Figure 7:
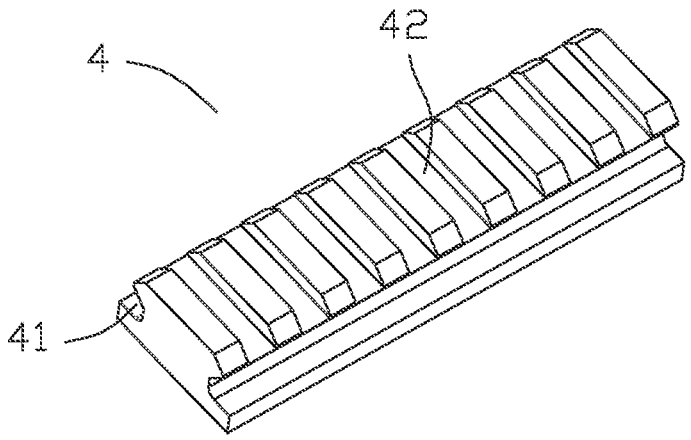
FIG. 7 is the three-dimensional structure diagram of an existing Picatinny rail.

The connection mechanism 3 is mounted on the bracket 1 and used to be detachably connected to Picatinny rail 4 (as shown in FIG. 7) on a sniper rifle.

When in use, first installing the connection mechanism 3 on the Picatinny rail 4 on sniper rifle, and then install the photoelectric instrument for gun on the buffer seat 21. When shooting, the sniper rifle recoils, the sniper rifle drives the Picatinny rail 4 to recoil, the Picatinny rail 4 drives the bracket 1 to recoil through the connection mechanism 3, the bracket 1 acts on the cushioning elastic 23, and the cushioning elastic 23 contracts, which can buffer the photoelectric instrument for gun installed on the buffer seat 21, reduce the recoil of the photoelectric instrument for gun, and prolong its service life.

In order to facilitate the installation of the cushioning elastic 23, please refer to FIG. 1, in a preferred embodiment, a bulge 211 is formed on the buffer seat 21, one end of the slide bar 22 is fixedly connected with the bulge 211, one end of the cushioning elastic 23 is in contact with the bulge 211, and the other end of the cushioning elastic 23 is in contact with the card block 11.

In order to specifically realize the detachable connection between the buffer seat 21 and the photoelectric instrument for gun, please refer to FIG. 1, in a preferred embodiment, a plurality of first mounting screw holes are formed on the photoelectric instrument for gun, the buffer seat 21 is provided with a plurality of second mounting screw holes 212 matched with the first mounting screw holes, the buffer seat 21 is connected with the photoelectric instrument for gun via a plurality of mounting screws (not shown), the mounting screws are threadedly connected to the first mounting screw holes and the second mounting screw holes 212.

In order to specifically realize the function of connection mechanism 3, please refer to FIG. 2 to FIG. 7, in a preferred embodiment, a card slot 12 is formed on the bracket 1, the card slot 12 is used to be clamped to the Picatinny rail 4 on a sniper rifle; the connection mechanism 3 comprises an abutment 31 and tightening drive 32, the tightening drive 32 is connected to the abutment 31 and is used to make the abutment 31 snap into side groove 41 of the Picatinny rail 4. When in use, the card slot 12 is clamped on the Picatinny rail 4, and then the abutment 31 is clamped into the side groove 41 of the Picatinny rail 4 through the tightening drive 32, so that the bracket 1 is fixedly connected to the Picatinny rail 4.

In order to specifically realize the function of the tightening drive 32, please refer to FIG. 2 to FIG. 7, in a preferred embodiment, an arc-shaped groove is also formed on the bracket 1; the tightening drive 32 comprises a turning block 321, a moving block 322, a pin 323, and compression elastic 324, the turning block 321 has a side wall matched with the arc-shaped groove, the side wall abuts the arc groove, the moving block 322 is slidably connected with the bracket 1, one end of the moving block 322 is provided with a limiting slot 3221, and the other end of the moving block 322 is fixedly connected to the abutment 31, one end of the pin 323 is fixed on the turning block 321, and the other end of the pin 323 is inserted into the limiting slot 3221, one end of the compression elastic 324 is fixedly connected to the bracket 1, and the other end of the compression elastic 324 is fixedly connected to the abutment 31. When in use, put the card slot 12 on the Picatinny rail 4, and then turn the turning block 321, when the turning block 321 rotates, since the pin 323 is eccentrically arranged on the turning block 321, the height of the pin 323 will increase during the turning of the turning block 321. The pin 323 drives the moving block 322 to move up through the limiting slot 3221, so that the abutment 31 is snapped into the side groove 41 of the Picatinny rail 4, so that the bracket 1 is fixedly connected to the Picatinny rail 4.

In order to facilitate the turning of the turning block 321, please refer to FIG. 2 to FIG. 6, in a preferred embodiment, the tightening drive 32 also comprises a knob 325, and the knob 325 is fixed on the turning block 321.

In order to improve the friction force between finger and the knob 325, please refer to FIG. 2 to FIG. 6, in a preferred embodiment, the knob 325 is formed with friction grooves 3251, which can increase the friction between the finger and the knob 325.

In order to limit the moving block 322, please refer to FIG. 2 to FIG. 6, in a preferred embodiment, a guide groove is formed on the inner bottom wall of the card slot 12, and the moving block 322 is slidably arranged in the guide groove.

In order to prevent the bracket 1 from sliding along the length direction of the Picatinny rail 4, please refer to FIG. 2 to FIG. 6, in a preferred embodiment, the moving block 322 is used to be clamped in the top groove 42 of the Picatinny rail 4.

In order to reduce the weight of bracket 1, please refer to FIG. 1, in a preferred embodiment, lightening holes 13 are also formed on the bracket 1.

In order to better understand this disclosure, the working process of the shock absorption device of photoelectric instrument for gun provided by this disclosure is described in detail below in conjunction with FIG. 1 to FIG. 7: when in use, put the card slot 12 on the Picatinny rail 4, and then turn the turning block 321, when the turning block 321 rotates, since the pin 323 is eccentrically arranged on the turning block 321, the height of the pin 323 will increase during the turning process. The pin 323 drives the moving block 322 to move up through the limiting slot 3221, so that the abutment 31 is snapped into the side groove 41 of the Picatinny rail 4, so that the bracket 1 is fixedly connected to the Picatinny rail 4, then installing the photoelectric instrument for gun on the buffer seat 21, when shooting, the sniper rifle recoils, the sniper rifle drives the Picatinny rail 4 to recoil, and the Picatinny rail 4 drives the bracket 1 to recoil through the connection mechanism 3, the bracket 1 acts on the cushioning elastic 23, and the cushioning elastic 23 contracts, so as to buffer the photoelectric instrument for gun installed on the buffer seat 21, reduce the recoil force of the photoelectric instrument for gun, and prolong its service life.

It is to be understood, however, that even though numerous characteristics and advantages of this disclosure have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A shock absorption device for photoelectric instrument for gun, comprising a bracket, a buffer mechanism, and a connection mechanism;

a card block is formed on the bracket, and a perforation is formed on the card block;

the buffer mechanism includes a buffer seat, a slide bar, and a cushioning elastic, the buffer seat is used for detachable connection with photoelectric instrument for gun, the slide bar is fixed on the buffer seat, the slide bar is slidably inserted in the perforation, the cushioning elastic is sleeved on the slide bar, one end of the cushioning elastic is connected to the buffer seat, the other end of the cushioning elastic is connected to the card block;

the connection mechanism is mounted on the bracket and used to be detachably connected to Picatinny rail on a sniper rifle.

2. The shock absorption device for photoelectric instrument for gun according to claim 1, wherein:

a bulge is formed on the buffer seat, one end of the cushioning elastic is abutted with the bulge, and the other end of the cushioning elastic is abutted with the card block.

3. The shock absorption device for photoelectric instrument for gun according to claim 1, wherein:

a plurality of first mounting screw holes are formed on the photoelectric instrument for gun, the buffer seat is provided with a plurality of second mounting screw holes matched with the first mounting screw holes, the buffer seat is connected with the photoelectric instrument for gun via a plurality of mounting screws, the mounting screws are threadedly connected to the first mounting screw holes and the second mounting screw holes.

4. The shock absorption device for photoelectric instrument for gun according to claim 1, wherein:

a card slot is formed on the bracket, and the card slot is used to be clamped to the Picatinny rail on a sniper rifle;

the connection mechanism comprises an abutment and a tightening drive, the tightening drive is connected to the abutment and is used to make the abutment snap into side groove of the Picatinny rail.

5. The shock absorption device for photoelectric instrument for gun according to claim 4, wherein:

an arc-shaped groove is also formed on the bracket;

the tightening drive comprises a turning block, a moving block, a pin, and a compression elastic, the turning block has a side wall matched with the arc-shaped groove, the side wall is in contact with the arc-shaped groove, the moving block is slidably connected to the bracket, one end of the moving block is provided with a limiting slot, the other end of the moving block is fixedly connected with the abutment, one end of the pin is fixed on the turning block, the other end of the pin is inserted into the limiting slot, one end of the compression elastic is fixedly connected to the bracket, the other end of the compression elastic is fixedly connected with the abutment.

6. The shock absorption device for photoelectric instrument for gun according to claim 5, wherein the tightening drive also comprises a knob, and the knob is fixed on the turning block.

7. The shock absorption device for photoelectric instrument for gun according to claim 6, wherein friction grooves are formed on the knob.

8. The shock absorption device for photoelectric instrument for gun according to claim 5, wherein a guide groove is formed on the inner bottom wall of the card slot, and the moving block is slidably arranged in the guide groove.

9. The shock absorption device for photoelectric instrument for gun according to claim 8, wherein the moving block is used to be clamped in top groove of the Picatinny rail.

10. The shock absorption device for photoelectric instrument for gun according to claim 1, wherein lightening holes are also formed on the bracket.

* * * * *